US010928017B1

(12) United States Patent
Avery, Jr.

(10) Patent No.: US 10,928,017 B1
(45) Date of Patent: Feb. 23, 2021

(54) LINEAR LIGHTING WITH SELECTABLE LIGHT OUTPUT LEVELS

(71) Applicant: Elemental LED, Inc., Reno, NV (US)

(72) Inventor: William H. Avery, Jr., Reno, NV (US)

(73) Assignee: Elemental LED, Inc., Reno, NV (US)

( * ) Notice: Subject to any disclaimer, the term of this patent is extended or adjusted under 35 U.S.C. 154(b) by 0 days.

(21) Appl. No.: 17/002,028

(22) Filed: Aug. 25, 2020

(51) Int. Cl.
*F21S 4/24* (2016.01)
*F21V 23/04* (2006.01)
*F21Y 103/10* (2016.01)
*F21Y 115/10* (2016.01)

(52) U.S. Cl.
CPC ..... *F21S 4/24* (2016.01); *F21V 23/04* (2013.01); *F21Y 2103/10* (2016.08); *F21Y 2115/10* (2016.08)

(58) Field of Classification Search
CPC ..... F21S 4/24; F21S 4/22; F21S 4/00; F21S 2/005; F21V 23/04
See application file for complete search history.

(56) References Cited

U.S. PATENT DOCUMENTS 5,758,947 A * 6/1998 Glatt ..... A42B 3/044 362/105
6,461,008 B1 * 10/2002 Pederson ..... B60Q 1/2611 362/35
6,600,274 B1 * 7/2003 Hughes ..... H05B 45/395 315/291
8,905,579 B2 * 12/2014 Dobbins ..... H05B 45/48 362/249.02
10,028,345 B2 * 7/2018 Petersen ..... H05K 1/189
10,041,636 B2 * 8/2018 Petersen ..... F21S 4/22
10,066,792 B2 * 9/2018 Del Castillo ..... F21K 9/278
10,194,496 B2 * 1/2019 Rogers ..... H05B 45/10
2005/0213321 A1 * 9/2005 Lin ..... F21S 4/26 362/231
2006/0133076 A1 * 6/2006 Sloan ..... F21V 33/006 362/216
2012/0326634 A1 * 12/2012 Li ..... F21S 4/24 315/312
2013/0107526 A1 * 5/2013 Ishibashi ..... H05K 1/189 362/237

(Continued)

OTHER PUBLICATIONS

U.S. Appl. No. 63/069,875, filed Aug. 25, 2020, Irons.

*Primary Examiner* — William N Harris
(74) *Attorney, Agent, or Firm* — United IP Counselors, LLC

(57) ABSTRACT

Lighting circuits using LED light engines and strips of linear lighting using these circuits are described. The lighting circuits are designed to produce different levels of light output at least in part using onboard components. In some embodiments, the circuit contains several current-setting elements, such as resistors, which are coupled to their own terminals such that the light output of the lighting circuit is determined by which of the terminals are connected to power. In other embodiments, a transistor in the lighting circuit may be adapted to allow or prevent current flow in the circuit based on a control signal applied to its gate. The circuit thus has separate power and control signal lines, and an external device, such as a pulse-width modulation signal generator, may be applied to the control signal line to modulate the light output.

20 Claims, 6 Drawing Sheets

(56) References Cited

U.S. PATENT DOCUMENTS

| | | | | |
|---|---|---|---|---|
| 2013/0313983 | A1* | 11/2013 | Radermacher | H05B 45/48 315/187 |
| 2014/0247595 | A1* | 9/2014 | Lind | F21K 9/20 362/249.04 |
| 2015/0092413 | A1* | 4/2015 | Li | F21S 4/22 362/249.04 |
| 2016/0138768 | A1* | 5/2016 | Greene | F21V 19/0025 362/249.04 |
| 2016/0178173 | A1* | 6/2016 | Yadav | F21V 23/005 362/231 |
| 2018/0031190 | A1* | 2/2018 | Nicolai | F21S 4/24 |
| 2019/0032870 | A1* | 1/2019 | Qiu | H05B 45/395 |
| 2019/0320515 | A1* | 10/2019 | Sadwick | H05B 47/16 |
| 2020/0284403 | A1* | 9/2020 | Grave | F21V 23/005 |

* cited by examiner

LINEAR LIGHTING WITH SELECTABLE LIGHT OUTPUT LEVELS

TECHNICAL FIELD

The invention relates to linear lighting, and in particular, to linear lighting with selectable light output levels.

BACKGROUND

Linear lighting is a class of lighting based on light-emitting diodes (LEDs) in which an elongate, narrow printed circuit board (PCB) is populated with a plurality of LED light engines, typically spaced from one another at a regular pitch or spacing. In much of the linear lighting on the market, the LED light engines are surface-mounted on the PCB, along with other components. The PCB itself may be either rigid or flexible.

Combined with an appropriate power supply, linear lighting may be considered a luminaire (i.e., a finished light fixture) in its own right. It may also be used as a raw material for the manufacture of other, more complex, luminaires.

The most popular form of linear lighting is flexible, cuttable linear lighting. In this form of linear lighting, a flexible PCB is divided into repeating blocks at defined cut points. Each repeating block is a self-contained lighting circuit that will light if connected to power. The cut points allow a manufacturer or an installer to choose the desired length of linear lighting by cutting the flexible PCB at the desired cut point and connecting the resulting length of linear lighting to power.

Linear lighting is typically a low-voltage product, operating at, e.g., 12 or 24 volts, direct current (DC), although for purposes of this description, the term "low voltage" refers to any voltage under about 50V. At a given voltage level, each repeating block of a strip of linear lighting is designed to provide a certain level of light output per repeating block, typically measured in lumens, a unit of luminous flux.

The circuitry in a typical strip of linear lighting is often simple, designed to produce a single level of light output per repeating block. If different or varied levels of light output are desired, there are two typical solutions. The first potential solution is to use an external device, such as a pulse-width modulation (PWM) dimmer, to vary light output. Yet the typical consumer-use household or commercial PWM dimmer is designed for large power loads, tends to be bulky and relatively expensive, and is not appropriate for many applications in which lower light output is desired from a strip of linear lighting.

The second potential solution is to manufacture a strip of linear lighting that is engineered to produce a lower light output. However, making a greater variety of products is not an elegant solution to the problem of varying the light output of linear lighting—it simply forces manufacturers and installers to stock a wider variety of products. Moreover, neither of these potential solutions are of much comfort to an installer who, after installing a strip of linear lighting, finds that it is simply too bright for the application and has to go to the trouble of ripping it out and installing a new one.

BRIEF SUMMARY

Aspects of the invention relate to lighting circuits for LED lighting, and to strips of linear lighting using these circuits. A lighting circuit according to one aspect of the invention includes a plurality of LED light engines, at least two current-setting elements, and a plurality of terminals. The plurality of terminals are electrically coupled to the at least two current-setting elements such that a light output of the lighting circuit is determined by which of the plurality of terminals are connected to power.

In one embodiment, the current-setting elements are resistors, several of which are arranged electrically in series with one another and with the LED light engines. The plurality of terminals includes several terminals at the cathode end of the strip of linear lighting, interposed between the resistors, such that the resistance in the circuit, and thus, the light output, are determined based on which resistor or resistors are connected within the circuit.

In another embodiment, the current-setting elements in the circuit are arranged in parallel with one another, and each of the current-setting elements is connected to its own terminal at the cathode end of the strip of linear lighting. The current in the circuit and the light output are determined based on which terminal or terminals are connected to power. The current-setting elements may be either resistors or current-setting integrated circuits.

Strips of linear lighting according to these aspects of the invention typically include an elongate, narrow printed circuit board (PCB) that is divided physically and electrically into repeating blocks, which are separated from one another at cut points. Each repeating block is a complete lighting circuit the features described above.

Another aspect of the invention relates to a lighting circuit that, in addition to a plurality of LED light engines and a current-setting element, has a transistor, and to strips of linear lighting that incorporate this lighting circuit. The lighting circuit has connections for power, and a separate control or signal input terminal that provides a voltage signal to the gate of the transistor. The transistor acts as a switch, allowing power to flow through the lighting circuit or preventing it from flowing based on the voltage signal supplied to its gate. This allows the lighting circuit to be driven by, e.g., an external pulse-width modulation (PWM) signal generator.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the description, and in which.

DETAILED DESCRIPTION

Figure 1:
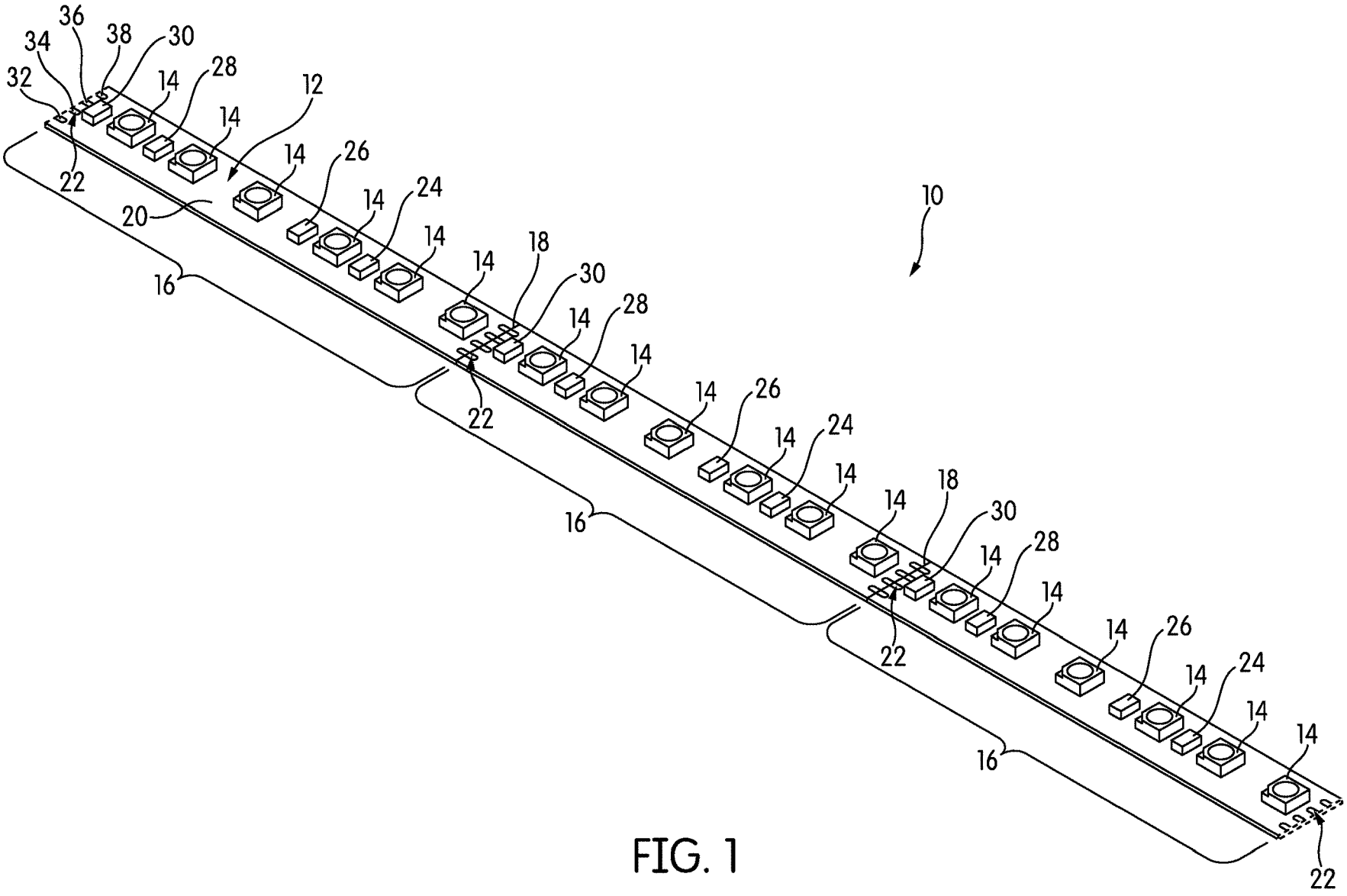
FIG. 1 is a perspective view of a strip of linear lighting according to one embodiment of the invention.

FIG. 1 is a perspective view of a strip of linear lighting, generally indicated at 10, according to an embodiment of the invention. The linear lighting 10 includes a printed circuit board (PCB) 12, on which a plurality of LED light engines 14 are disposed, spaced from one another at a regular spacing or pitch.

As the term is used here, "LED light engine" refers to an element in which one or more light-emitting diodes (LEDs) are packaged, along with wires and other structures, such as electrical contacts, that are needed to connect the light engine to a PCB. If the light engine is intended to emit "white" light, it may be a so-called "blue pump" light engine in which a light engine containing one or more blue-emitting LEDs (e.g., InGaN LEDs) is covered with a phosphor, a chemical compound that absorbs the emitted blue light and re-emits a broader or a different spectrum of wavelengths. In the illustrated embodiment, the light engines 14 are surface-mount devices (SMDs) soldered to the PCB 12, although other types of light engines may be used. The particular type of light engine is not critical, and other types of light engines may be used. While multi-color RGB LED light engines that can emit a variety of colors may be used in embodiments of the invention, much of this description will assume that the LED light engines emit light of a single color.

In FIG. 1, the PCB 12 is a flexible PCB made, for example, of a thin MYLAR® (biaxially-oriented polyethylene terephthalate) or polyimide film, although in some embodiments, it may be a rigid PCB made of a material like FR4 or ceramic. The material of which the PCB is made is not critical, so long as it is suitable for the application in which the linear lighting 10 is to be used. While the LED light engines 14 and other devices on the PCB 12 are SMDs in the illustrated embodiment, other forms of mounting may also be used, including through-hole mounting.

The linear lighting 10 is divided into repeating blocks 16. Each repeating block 16 is a complete lighting circuit that will light if connected to power. The repeating blocks 16 can be separated from one another at cut points 18. In the illustration of FIG. 1, the cut points 18 are marked on the upper surface 20 of the PCB 12, e.g., by screen printing. However, in other embodiments, the cut points 18 may not be explicitly marked. When the cut points 18 are not explicitly marked, the locations of the cut points 18 can typically be deduced by using landmarks on the PCB 12. For example, in this case, the cut points 18 coincide with sets of solder pads, each of which is generally indicated at 22. While the term "solder pads" is used here for convenience, the sets of solder pads 22 may be used to make other types of electrical connections, such as connections using solderless electrical connectors.

Typically, most PCBs for linear lighting are on the order of 5-14 mm wide, although narrower and wider PCBs do exist. By joining sections of PCB 12 together at overlapping solder joints, a strip of linear lighting 10 may be made arbitrarily long. For example, 4 meter (16.4 foot) rolls of linear lighting are common in the industry, and 30 meter (100 foot) rolls of linear lighting are not unknown. Longer rolls of linear lighting 10 may be helpful for manufacturers and installers who use the product in great quantities; the functional maximum usable length (in industry parlance, the maximum run length) of any particular strip of linear lighting 10 may depend on a number of factors, and will be described in greater detail below.

In this embodiment, the devices in each repeating block 16 are relatively few: there are six LED light engines 14 and four resistors 24, 26, 28, 30. The resistors 24, 26, 28, 30 are typically mounted in the interstitial space between LED light engines 14 or along the sides of the PCB 12. Like the LED light engines 14, the resistors 24, 26, 28, 30 are SMDs, and may be, e.g., 0805 resistors.

The resistors 24, 26, 28, 30 of the linear lighting 10 are but one example of a broader class of current-setting elements. As those of skill in the art will appreciate, LED light engines 14 require some element to set the current in the circuit. This may be done in the power supply (i.e., in the driver), or it may be done by adding components to the PCB 12 itself to set the current flow. Linear lighting that is designed to be used with an external driver that controls the current flow is called "constant current" linear lighting. Linear lighting that is designed to control the current flow using its own on-board circuits is often referred to as "constant voltage" linear lighting. Constant-current linear lighting is often used when the length of the linear lighting is known in advance; constant-voltage linear lighting is more versatile and more easily used in situations where the length, and resulting current draw, is unknown or is likely to vary from one installation to the next. This description assumes that the linear lighting 10 is constant-voltage linear lighting; thus, the presence of the resistors 24, 26, 28, 30. Some of the resistors 24, 26, 38, 30 have an additional purpose that will be described in greater detail below.

Figure 2:
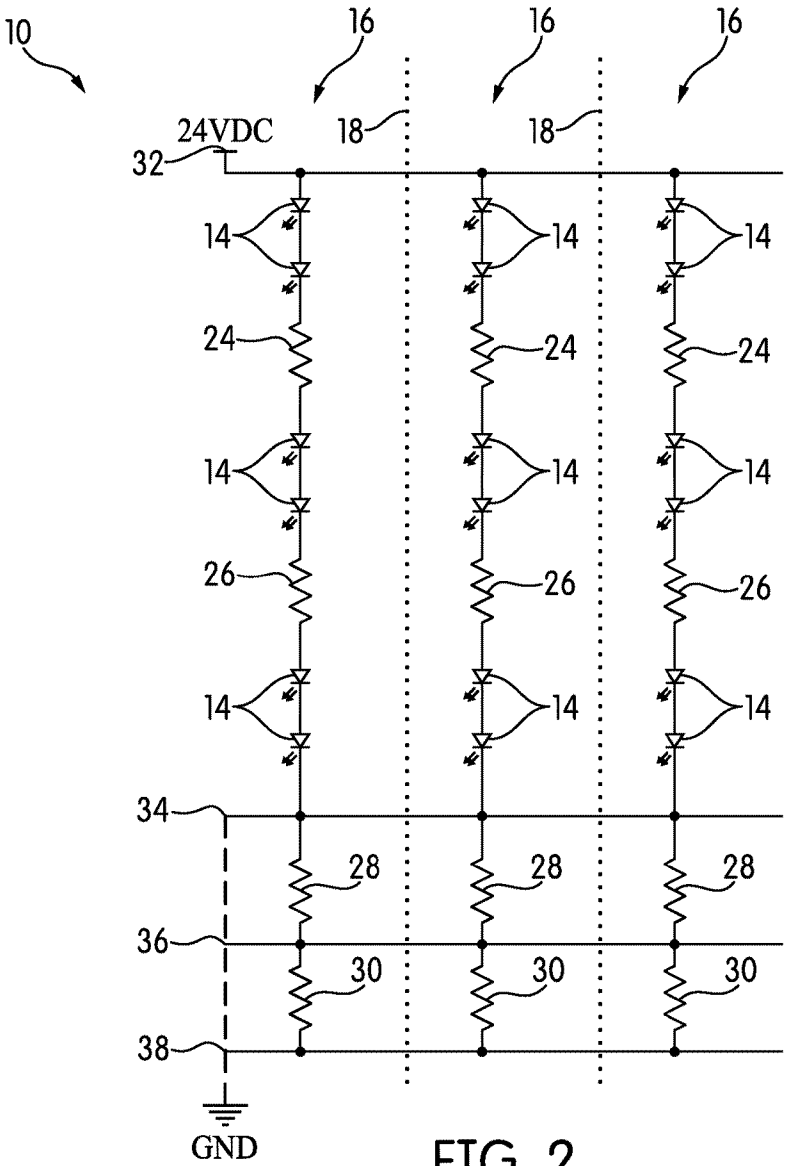
FIG. 2 is a circuit diagram of the strip of linear lighting of FIG. 1.

FIG. 2 is a schematic circuit diagram of the linear lighting 10 of FIG. 1. As can be appreciated from FIG. 2, while the repeating blocks 16 are physically in series with one another, they are electrically in parallel with each other between the power source and ground. Physically, the PCB 12 is typically constructed as a two-layer board, with the lower layer a power bus that connects to each repeating block 16 and the upper layer dedicated to interconnecting conductors and other structure for a circuit like that of FIG. 2.

The circuit of FIG. 2 assumes a constant voltage input 32 with a variable current that increases according to the number of repeating blocks 16 in the strip of linear lighting 10. In the embodiment of FIGS. 1-2, there are six LED light engines 14 in each repeating block 16. This is typical for a 24V circuit and assumes that each LED light engine 14 has a forward voltage in the range of about 3-3.3V. If the operating voltage or the forward voltages are different, there may be more or fewer LED light engines 14.

In each repeating block 16, the first two resistors 24, 26 perform the usual function of setting the current in the circuit. These may be, e.g., 240 resistors capable of handling, e.g., 65 mW of power. Of course, the values of the resistors and their power tolerances will vary considerably from embodiment to embodiment. Since the two resistors 24, 26 are in series with one another within the repeating block, they could be replaced by a single resistor with a resistance that is the additive sum of the resistances of the two smaller resistors. That single resistor would have an appropriate power tolerance. The advantage of dividing the total resistance and physically spacing it along the PCB 12 is heat dissipation: having two resistors 24, 26 creates two less-hot spots that are spaced along the PCB 12. For that reason, the necessary resistance could be divided among any number of resistors, spaced along the PCB 12.

The six LED light engines 14 and two resistors 24, 26 form a full, conventional constant-voltage lighting circuit. However, there are two additional resistors 28, 30 placed electrically in series with one another and with the other components 14, 24, 26 of the repeating block 16. The repeating block 16 is also arranged so that there are a number of terminals 34, 36, 38 at the cathode end of the strip of linear lighting 10, with terminal 34 positioned in series before the two additional resistors 28, 30, terminal 36 placed in series between the first additional resistor 28 and the second additional resistor 30, and terminal 38 placed in series after the third additional resistor 30.

As shown in FIG. 1, the terminals 34, 36, 38 would typically be part of the solder pads 22 on the upper layer of the PCB 12 and would physically be placed adjacent to one another on the PCB 12, although there is no requirement that this be so. Thus, the term "cathode end" of the strip of linear lighting 10, and other similar terms, should be taken to refer to the circuit diagram of FIG. 2, and not to the physical strip of linear lighting 10. Additionally, as will be described below in more detail, the sense of the circuit in some embodiments may be reversed such that the terminals are on the anode end of the strip of linear lighting.

Typically, when connecting the strip of linear lighting 10 to power, an installer will use the set of solder pads 22 that is closest to one end of the strip of linear lighting 10. However, that need not always be the case. Because of the arrangement of the repeating blocks 16 and the presence of a power bus within the strip of linear lighting 10, any set of solder pads 22 along the strip of linear lighting 10 may be used. Additionally, in many strips of linear lighting, conductors are accessible from the bottom of the strip; therefore, there is no requirement that the solder pads 22 or other such contacts be on the upper surface of the strip of linear lighting 10.

Furthermore, much of this description assumes that the strip of linear lighting 10 is powered from a single set of solder pads 22 at one end of the strip of linear lighting 10. This need not be the case in all embodiments. If desired, power could be input simultaneously in multiple places along the strip of linear lighting 10 using any of the sets of solder pads 22 found along its length. The advantage of powering the strip of linear lighting 10 in this way is that it the light output disparity between one end of the strip of linear lighting 10 and the other would be reduced, thereby extending the maximum run length.

In any working circuit, only one of the three terminals 34, 36, 38 need be connected. With the arrangement shown in FIG. 2, the light output of the repeating blocks 16, and thus the light output of the linear lighting 10, depends on which terminal 34, 36, 38 is connected. (As those of skill in the art may appreciate from FIG. 2, if more than one terminal 34, 36, 38 is connected, the light output is determined only by the first terminal 34, 36, 38 in the series that is connected.) When the first terminal 32 is connected, each repeating block 16 would emit at its full light output level. However, if either of the other two terminals 36, 38 are connected instead of the first terminal, the repeating blocks 16 would emit light at less than full output. By Ohm's Law, the increased resistance provided by one or both of the additional resistors 28, 30 (depending on which terminal 36, 38 is connected) at constant voltage would cause a drop in the current, which would result in less light output from the LED light engines 14. The decrease seen in any particular embodiment depends on the resistances of the two additional resistors 28, 30.

In the illustrated embodiment, resistor 28 has a resistance equal to the additive sum of the resistances of the two resistors 24, 26 in the main portion of the repeating block 16. If terminal 36 is connected, placing resistor 28 in the circuit, the light output would drop to one-half of the full light output. Resistor 30 has a resistance that is the additive sum of the resistances of the resistors 24, 26, 28. If terminal 38 is connected, placing both resistors 28, 30 in the circuit, the light output would drop to one-quarter of the full light output. Both of the additional resistors 28, 30 have appropriate power capacities—for example, if the main resistors 24, 26 are 65 mW resistors, resistor 28 may have a power capacity of 32 mW and resistor 30 may have a power capacity of 18 mW.

As a practical matter, this means that a manufacturer or an installer can choose the light output of the strip of linear lighting 10 from among a number of options at the time of manufacture or installation by choosing which of the terminals 34, 36, 38 to use in connecting the strip of linear lighting 10 to the power circuit. This may be done by soldering, by using a connector, or by any other means of making an electrical connection. As those of skill in the art will realize, while three terminals 34, 36, 38 are shown in this embodiment, there is no theoretical limit on the number of terminals, and thus, luminance options, that may be provided, but for practical reasons, it is helpful if the resulting terminals 34, 36, 38 are large enough to be used. Additionally, in this embodiment, the terminals 34, 36, 38 are cathodic terminals. That is not the only possible configuration and, as was noted briefly above, the sense of the circuit may be reversed and the terminals may be anodic terminals.

The actual resistances of the resistors 24, 26, 28, 30, and their power capacities, may vary considerably from embodiment to embodiment. In particular, for reasons of perception, it may be desirable to have light output levels other than full, one-half, and one-quarter, or to base the definitions of full, one-half, and one-quarter on perceived brightness, rather than luminous flux. In most practical embodiments, it is the perception of brightness to a human (or other animal) observer that matters, and not the luminous flux of the lighting source or the luminance of an area or object. Brightness is not necessarily proportional to luminous flux or luminance, and there are even cases in which a light source that emits a lesser luminous flux may be perceived as brighter than another light source that emits a greater luminous flux. As one example, the Helmholtz-Kohlrausch effect is a perceptual phenomenon in which intensely saturated colors are seen by the human eye as brighter than white light. For these reasons, even if full, one-half, and one-quarter are desired light output levels for a strip of linear lighting, the meanings of those terms, and the resulting resistance values of the resistors, may be chosen with respect to perceived brightness, rather than luminous flux or luminance.

Figure 3:
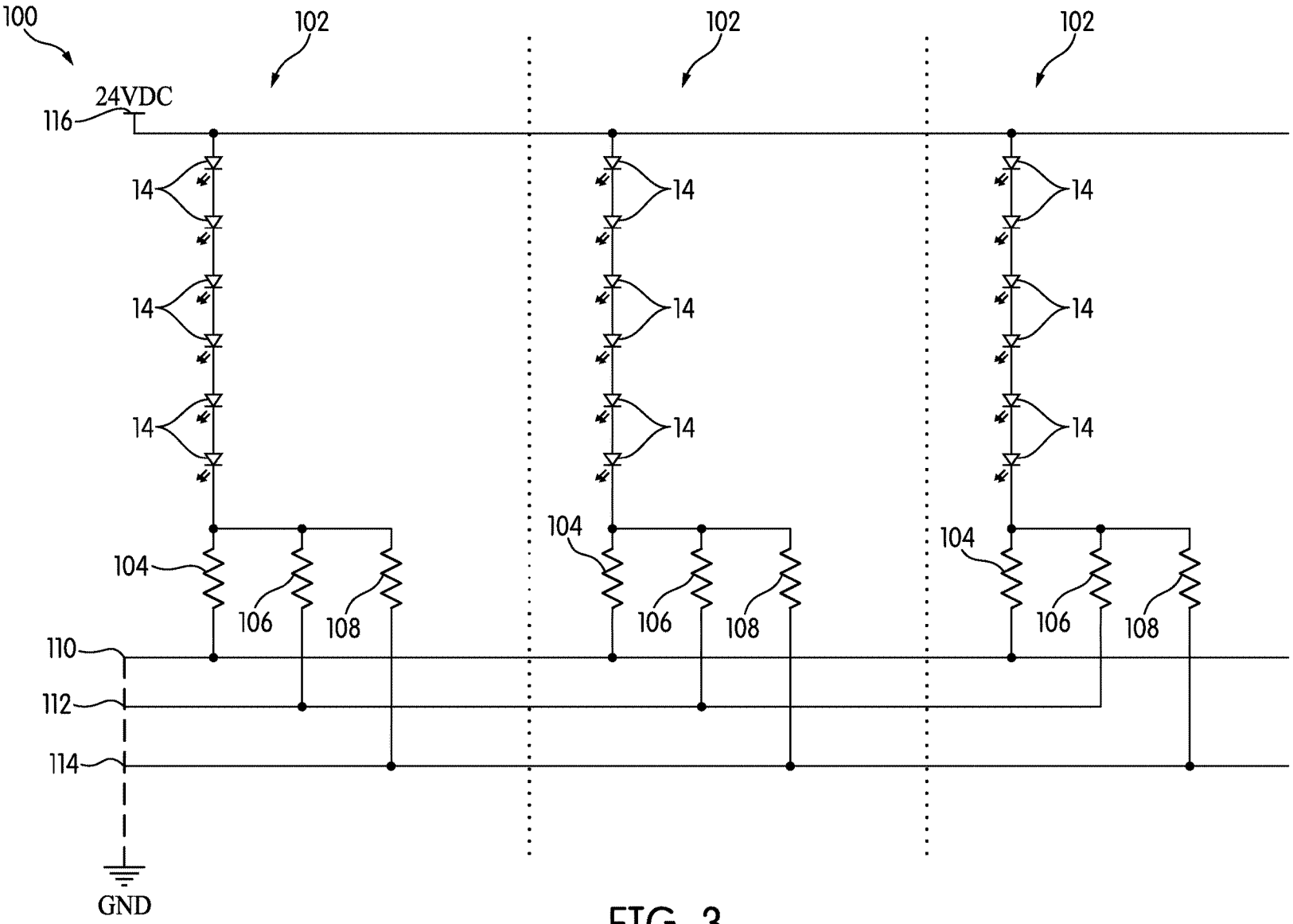
FIG. 3 is a circuit diagram of a strip of linear lighting according to another embodiment of the invention.

In the embodiment of FIGS. 1-2, all of the components in each repeating block 16 are electrically in series with one another. This need not be the case in all embodiments. FIG. 3 is a circuit diagram of a strip of linear lighting, generally indicated at 100, according to another embodiment of the invention. Three repeating blocks 102 are shown in the view of FIG. 3, although the description above with respect to linear lighting also applies to the linear lighting 100 of FIG. 3, and any number of repeating blocks 102 may be included in a strip of linear lighting 100 of arbitrary length.

Each repeating block 102 has six LED light engines 14, a configuration which, like the one above, assumes 24V DC input power with about a 3-3.3V forward voltage for each LED light engine 14. The difference in the strip of linear lighting 100 relative to the strip of linear lighting 10 described above lies in the configuration of the resistors 104, 106, 108. As can be seen in FIG. 3, there are three resistors 104, 106, 108 in each repeating block 100, each resistor 104, 106, 108 in parallel with the others.

The repeating block 102 has three terminals 110, 112, 114 at the cathode end of the strip of linear lighting 100, each one connected to one of the resistors 104, 106, 108. As described above, these terminals 110, 112, 114 may be part of a set of solder pads on the upper surface of a PCB 12, although other arrangements are possible. The fourth terminal 116 is the anode, which may also be a solder pad. As with the embodiment described above, the sense of the circuit may be reversed such that in some cases, the terminals 110, 112, 114 are anodic and the fourth terminal 116 is the cathode.

In the arrangement of FIG. 3, one or more of the resistors 104, 106, 108 are connected to the circuit simultaneously based on which of the three terminals 110, 112, 114 are connected to the circuit—and unlike in the linear lighting 10 described above, more than one terminal 110, 112, 114 may be connected at once. The resistor or resistors 104, 106, 108 that are connected determine the total resistance and, therefore, the luminous flux. Each resistor 104, 106, 108 may have a different resistance. Depending on the desired light output, one, two, or all three resistors 104, 106, 108 may be connected to the circuit. If soldering multiple wires to solder pads is undesirable, other solutions, like jumpers or DIP switches, may be used to connect multiple resistors 104, 106, 108 at once. As those of skill in the art will understand, if all three resistors 104, 106, 108 have different resistances, then there are seven different possible combinations, and thus, seven different potential light output levels. As one example, resistor 104 may have a resistance of 3.36 kΩ and a power capacity of 19 mW, resistor 106 may have a resistance of 1.68 kΩ and a power capacity of 37 mW, and resistor 108 may have a resistance of 840Ω and a power capacity of 74 mW. The resistances of the resistors 104, 106, 108 could be chosen to create the greatest range of differences in perceived brightness among the various light output options, or the resistances could be chosen to provide fine gradations in perceived brightness around a general level of light output.

Figure 4:
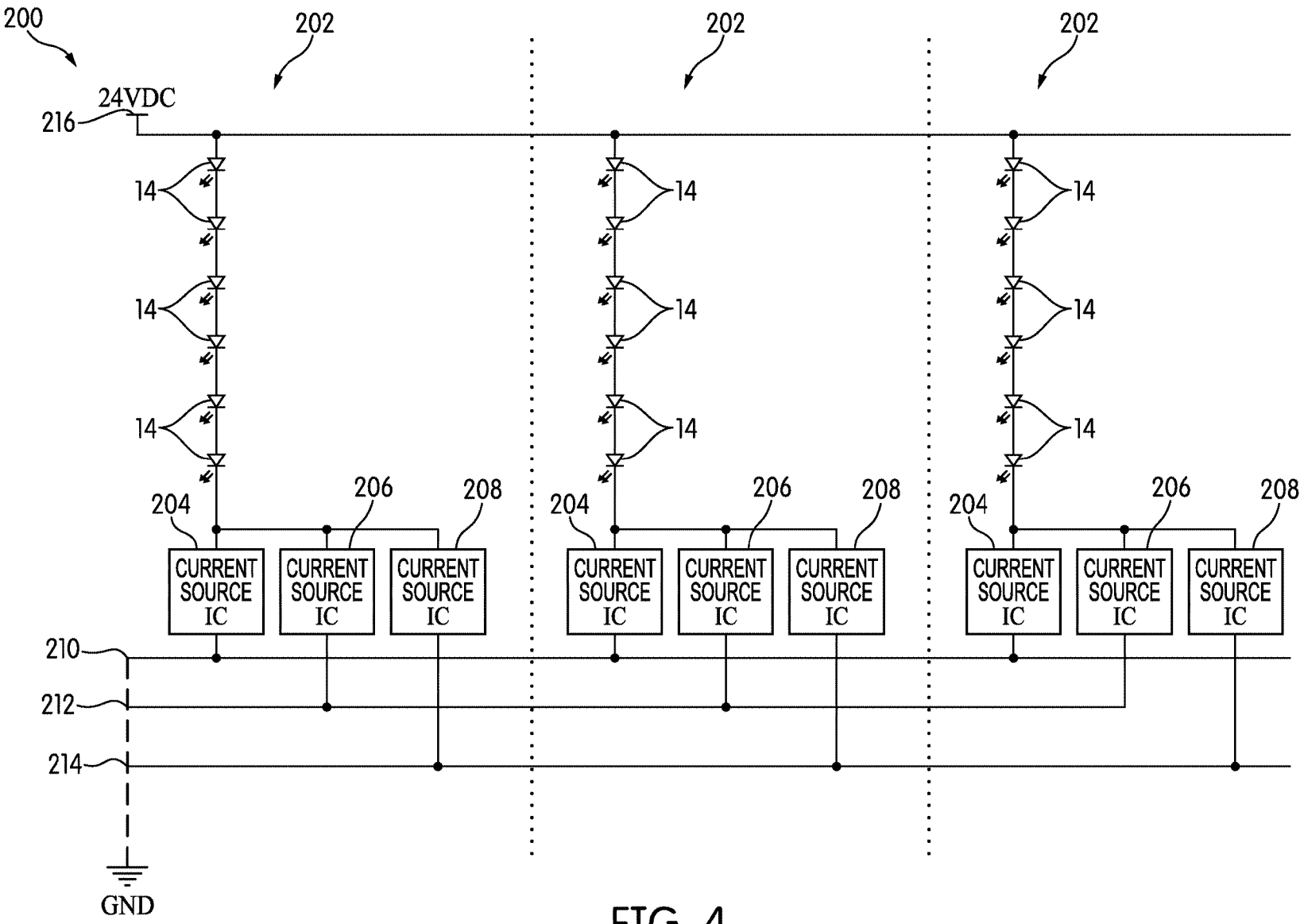
FIG. 4 is a circuit diagram of a strip of linear lighting according to yet another embodiment of the invention.

As was noted above, resistors are but one example of current-setting devices that may be used in linear lighting circuits, and embodiments of the invention may include other types of current-setting devices. For example, FIG. 4 is a circuit diagram of a strip of linear lighting, generally indicated at 200, according to another embodiment of the invention. Like the previous embodiments, in the view of FIG. 4, three repeating blocks 202 are shown, arranged electrically in parallel with one another along the strip of linear lighting 200, although any number of repeating blocks 202 may be present in a strip of linear lighting 200. Each repeating block 202 assumes a 24 VDC input and has six LED light engines 14, like the other embodiments.

The difference in the repeating blocks 202, as compared with those of other embodiments, lies in their current-setting components. Instead of resistors 104, 106, 108, each repeating block 202 has three current source/driver integrated circuits 204, 206, 208. As in the strip of linear lighting 100 of FIG. 3, these are arranged in parallel with one another. Also similar to FIG. 3, each integrated circuit 204, 206, 208 has its own terminal 210, 212, 214 at the cathode end of the strip of linear lighting 200.

The integrated circuits 204, 206, 208 perform the current-setting function in the strip of linear lighting 200, serving as constant current drivers for the LED light engines 14. Typically, each integrated circuit 204, 206, 208 is designed to supply a different current level. The current levels may be, e.g., 2 mA, 4 mA, and 8 mA, for example, although as explained above, the current levels may be chosen in accordance with the perception of brightness, rather than the luminous flux they allow. As with the linear lighting 100 of FIG. 3, the light output of the linear lighting 200 would depend on which of the terminals 210, 212, 214 are connected to power. Thus, as the linear lighting 200 of FIG. 4 demonstrates, embodiments of the invention may include any element or group of elements that can control or regulate the current in a circuit, and are not limited to resistors.

While current-setting ICs 204, 206, 208 may be slightly more expensive than resistors, it is possible that their use may result in a lower total resistance and allow for longer maximum run lengths.

There is a commonality in all of these embodiments: each repeating block includes at least one additional terminal, coupled to at least one additional current-setting element, be it a resistor or a current-control IC, and the terminal or terminals that are actually connected to the circuit determine the ultimate light output of the repeating block and of the strip of linear lighting as a whole.

As those of skill in the art will note, all of the above-described embodiments assume a DC voltage input. However, there are situations in which a time-varying voltage is used with linear lighting, e.g., the use of a pulse-width modulation (PWM) signal in order to change the duty cycle and effective light output of a strip of linear lighting.

Certain embodiments of the invention may include a component or components to make the strip of linear lighting more compatible with PWM signals, as well as other types of time-varying signals.

Figure 5:
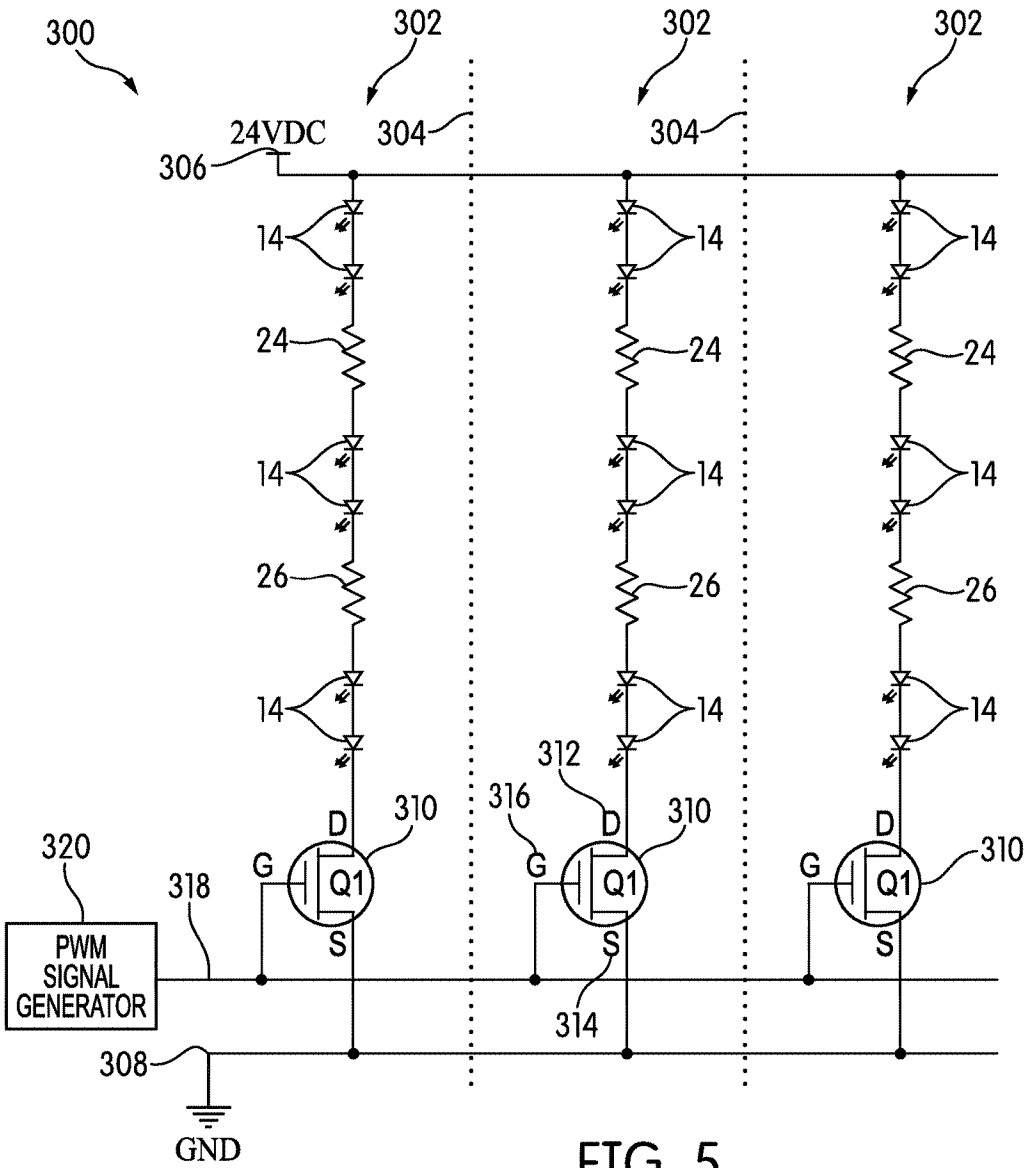
FIG. 5 is a circuit diagram of a strip of linear lighting according to a further embodiment of the invention.

FIG. 5 is a circuit diagram of a strip of linear lighting, generally indicated at 300, according to another embodiment of the invention. Like the embodiments described above, the strip of linear lighting 300 is divided into repeating blocks 302 by cut points 304. The repeating blocks 302, three of which are shown in FIG. 5, are electrically in parallel with one another between power 306 and ground 308. In the illustrated embodiment, much like the other embodiments, power is assumed to be a 24 VDC supply, and each repeating block 302 has six light-emitting diodes 14 and two resistors 24, 26.

Each repeating block 302 has one additional component that, like the others, may be, e.g., surface mounted on the PCB 12 of the strip of linear lighting 300: a transistor, specifically an N-channel CMOS field-effect transistor (FET) 310. The drain 312 of the transistor 310 is connected to the cathode end of the strip of linear lighting 300 and the source 314 is connected to ground 308. The gate 316 of the transistor 302 is connected to a signal line 318 that runs the length of the strip of linear lighting 300 in parallel with power 306 and ground 308. The signal line 318 would typically have a terminal in the sets of solder pads 22 on the top surface of the PCB 12, although as was described above, other locations are possible.

Arranged this way in each repeating block 302, the transistor 310 acts as a switch. If the signal 318 applied to the gate 316 of the transistor 310 is equal to or exceeds the threshold voltage of the transistor 310, current flows through the circuit. The threshold gate-to-source voltage of a typical transistor 310 is typically much lower than the voltage used to drive the repeating blocks 302, e.g., about 1.5 volts. Thus, the strip of linear lighting 300 of FIG. 5 takes DC power at a first, higher voltage (e.g., 12 or 24V) and has a separate control signal, which may be of much lower voltage (e.g., 1.5-3V). That control signal may be modulated, e.g., with a PWM scheme, to change the duty cycle of the lighting and create an effective light output that is proportional to the duty cycle of the control signal.

In order to create an appropriate control signal, the strip of linear lighting 300 may be connected to a signal generator 320, such as a PWM signal generator. This may take the form of a small module connected to one end of the strip of linear lighting 300. Of course, any other type of signal generator may be used, and in some embodiments, signals other than PWM may be used, e.g., to create a strobing effect or some other desired lighting effect.

With any oscillating signal, there is always a risk of generating electromagnetic interference. The sharp corners of a square-wave PWM signal may increase this risk. If necessary, each repeating block 302 may include a capacitor, or another such filtering element, to smooth the signal somewhat and reduce the possibility of electromagnetic interference. The control signal may also be programmed with slower rise and fall times to reduce electromagnetic interference.

There are several potential advantages to the arrangement shown in FIG. 5. For one, because PWM is performed on a lower-voltage control signal, the hardware used as the PWM generator 320 can be lower-voltage, lower-power, and potentially smaller than traditional PWM dimmers used to modulate, e.g., a 120V AC power signal or a 24V, 4 A DC power signal. The PWM generator 320 itself may have switches or a knob to allow the light output to be adjusted at the time of installation. The arrangement of the linear lighting 300 may also allow for greater compatibility with a variety of other types of modulation schemes and electronics, because only a very low voltage must be modulated to achieve the same effect that previously required the modulation of a 12V or 24V signal.

Figure 6:
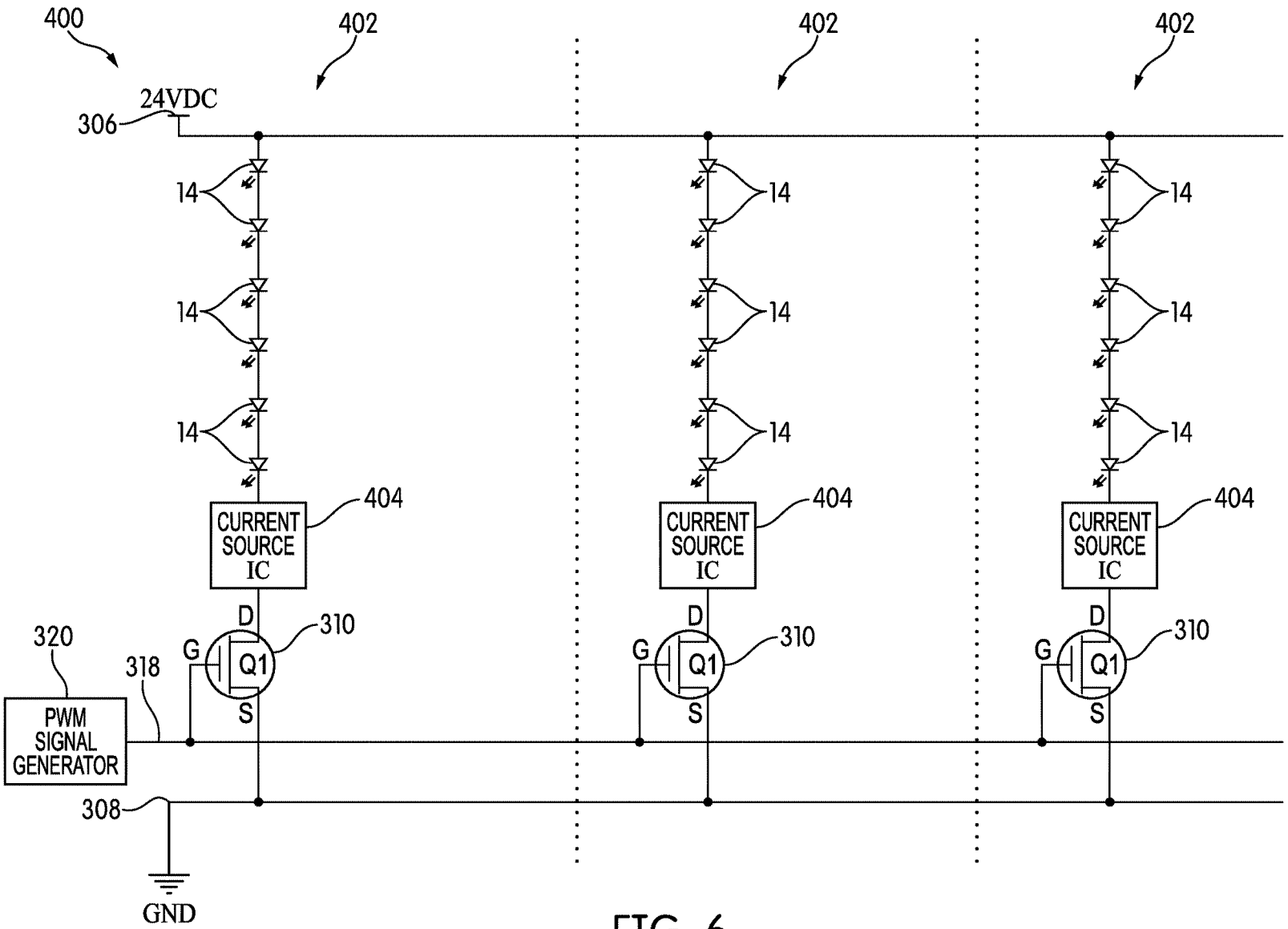
FIG. 6 is a circuit diagram of a strip of linear lighting according to another further embodiment of the invention.

FIG. 6 is a circuit diagram of a strip of linear lighting, generally indicated at 400, that is a variation on the strip of linear lighting 300 of FIG. 5. The strip of linear lighting 400 has repeating blocks 402 that are virtually identical to the repeating blocks 302 of FIG. 5. In particular, they include the transistor 310 described above, as well as the signal line 318 to which a PWM signal generator 320 is attached. The difference between the repeating blocks 302, 402 lies in the current-setting elements: the repeating blocks 402 of FIG. 6 are devoid of resistors 24, 26 and instead use current-setting ICs 404 in their place. As explained above, this may allow for a longer functional maximum run length.

While the invention has been described with respect to certain embodiments, the description is intended to be exemplary, rather than limiting. Modifications and changes may be made within the scope of the invention, which is defined by the appended claims.

What is claimed is:

1. A lighting circuit, comprising:

a plurality of LED light engines;

at least two current-setting components, including a first current-setting component arranged electrically in series with the plurality of LED light engines, and a second current-setting component arranged electrically in series with the plurality of LED light engines and the first current-setting component; and a plurality of terminals adapted to make electrical connections with the circuit, the plurality of terminals including a first terminal connected between the first current-setting component and the second current-setting component and a second terminal connected after the second current-setting component;

wherein, in operation, a light output of the lighting circuit is determined, at least in part based on which of the first or second terminals is connected to the power.

2. The lighting circuit of claim 1, wherein the first current-setting component comprises a first resistor and the second current-setting component comprises a second resistor.

3. The lighting circuit of claim 1, wherein:

the at least two current-setting components comprise a third current-setting component arranged electrically in series with the plurality of LED light engines, the first current-setting component, and the second current-setting component; and the plurality of terminals includes a third terminal connected after the third current-setting component.

4. The lighting circuit of claim 1, wherein the plurality of terminals comprise solder pads.

5. The lighting circuit of claim 1, wherein the power comprises DC power.

6. The lighting circuit of claim 5, wherein the power comprises low-voltage DC power.

7. The lighting circuit of claim 1, wherein the at least two current-setting components comprise current-setting integrated circuits.

8. A strip of linear lighting, comprising:

an elongate, narrow printed circuit board (PCB) divided physically and electrically into repeating blocks, each of the repeating blocks including a lighting circuit, the lighting circuit of each of the repeating blocks having:

a plurality of LED light engines, at least two current-setting components, including a first current-setting component arranged electrically in series with the plurality of LED light engines, and a second current-setting component arranged electrically in series with the plurality of LED light engines and the first current-setting component, and a plurality of terminals adapted to make electrical connections, the plurality of terminals including a first terminal connected between the first current-setting component and the second current-setting component and a second terminal connected after the second current-setting component such that, in operation, a light output of the lighting circuit is determined, at least in part, based on which of the first or second terminals is connected to the power;

wherein the plurality of terminals is electrically connected to a corresponding plurality of conductors that runs substantially an entirety of the length of the PCB.

9. The strip of linear lighting of claim 8, wherein the PCB is flexible.

10. The strip of linear lighting of claim 8, wherein the repeating blocks are divided from one another at cut points.

11. The strip of linear lighting of claim 10, wherein the cut points are marked on the PCB.

12. The strip of linear lighting of claim 8, wherein the at least two current-setting components further comprise:

a third current-setting component arranged electrically in series with the plurality of LED light engines, the first current-setting component, and the second current-setting component; and the plurality of terminals includes a third terminal connected after the third current-setting component.

13. Alighting circuit, comprising:

a plurality of LED light engines;

at least two current-setting components arranged electrically in parallel with one another; and a plurality of terminals adapted to make electrical connections with the circuit, each of the at least two current-setting components connected to one of the plurality of terminals such that, in operation, a light output of the lighting circuit is determined, at least in part, by which of the plurality of terminals are connected to power.

14. The lighting circuit of claim 13, wherein the plurality of terminals comprise solder pads.

15. The lighting circuit of claim 13, wherein the power comprises DC power.

16. The lighting circuit of claim 13, wherein the at least two current-setting components comprise resistors or current-setting integrated circuits.

17. A strip of linear lighting, comprising:

an elongate, narrow printed circuit board (PCB) divided physically and electrically into repeating blocks, each of the repeating blocks including a lighting circuit having a plurality of LED light engines, at least two current-setting components arranged electrically in parallel with one another, and a plurality of terminals adapted to make electrical connections with the circuit, each of the at least two current-setting components connected to one of the plurality of terminals such that, in operation, a light output of the lighting circuit is determined, at least in part, by which of the plurality of terminals are connected to power;

wherein the plurality of terminals is electrically connected to a corresponding plurality of conductors that runs substantially an entirety of the length of the PCB.

18. The lighting circuit of claim 17, wherein the plurality of terminals comprise solder pads.

19. The lighting circuit of claim 17, wherein the power comprises DC power.

20. The lighting circuit of claim 17, wherein the at least two current-setting components comprise resistors or current-setting integrated circuits.

* * * * *